US008014552B2

(12) United States Patent
Waldron

(10) Patent No.: US 8,014,552 B2
(45) Date of Patent: Sep. 6, 2011

(54) APPARATUS FOR COMMUNICATION COUPLING WITH A HEARING AID

(75) Inventor: Joan Phillips Waldron, Fort Collins, CO (US)

(73) Assignee: Able Blanet, Incorporated, Wheat Ridge, CO (US)

( * ) Notice: Subject to any disclaimer, the term of this patent is extended or adjusted under 35 U.S.C. 154(b) by 1035 days.

(21) Appl. No.: 11/850,541

(22) Filed: Sep. 5, 2007

(65) Prior Publication Data

US 2008/0056521 A1 Mar. 6, 2008

Related U.S. Application Data

(62) Division of application No. 10/411,867, filed on Apr. 11, 2003, now Pat. No. 7,317,807.

(60) Provisional application No. 60/372,355, filed on Apr. 12, 2002.

(51) Int. Cl.
*H04R 25/00* (2006.01)

(52) U.S. Cl. ..... 381/331; 381/326

(58) Field of Classification Search ..... 381/312, 381/326, 330, 331; 455/575.2; 379/52, 443, 379/444

See application file for complete search history.

(56) References Cited

U.S. PATENT DOCUMENTS

| | | | | |
|---|---|---|---|---|
| 2,048,604 | A | 7/1936 | Finch | 179/2 |
| 2,554,834 | A | 5/1951 | Lavery | 179/107 |
| 2,837,607 | A | 6/1958 | McGenn | 179/107 |
| 3,396,245 | A | 8/1968 | Flygstad | 179/107 |
| 3,668,334 | A | 6/1972 | Schwake | 179/107 R |
| 3,742,359 | A | 6/1973 | Behymer | 325/26 |
| 3,862,378 | A | 1/1975 | Norris | 179/156 A |
| 4,137,431 | A | 1/1979 | Pallesen | 179/107 H |
| 4,160,122 | A | 7/1979 | Jacobson | 179/1 A |
| 4,403,120 | A | 9/1983 | Yoshimi | 179/182 R |
| 4,420,657 | A | 12/1983 | Larkin | 179/156 |
| 4,539,439 | A | 9/1985 | Strothmann et al. | 179/107 R |
| 4,543,453 | A | 9/1985 | Brander | 179/107 |
| 4,697,283 | A | 9/1987 | Lafrance et al. | 379/443 |
| 4,701,958 | A | 10/1987 | Neth | 381/68 |
| 4,723,293 | A | 2/1988 | Harless | 381/68 |
| 4,930,156 | A | 5/1990 | Norris | 379/388 |
| 4,957,478 | A | 9/1990 | Maniglia | 600/25 |
| 5,010,575 | A | 4/1991 | Marutake et al. | 381/68 |
| 5,058,155 | A | 10/1991 | Larsen | 379/442 |
| 5,086,464 | A | 2/1992 | Groppe | 379/430 |
| 5,091,952 | A | 2/1992 | Williamson et al. | 381/68.2 |
| 5,434,924 | A | 7/1995 | Jampolsky | 381/68.4 |
| 5,615,229 | A | 3/1997 | Sharma et al. | 375/259 |
| 5,740,257 | A | 4/1998 | Marcus | 381/71.6 |
| 5,796,821 | A | 8/1998 | Crouch et al. | 379/430 |
| 6,122,500 | A | 9/2000 | Dent et al. | 455/414 |
| 6,925,179 | B2 | 8/2005 | Waldron et al. | 379/443 |
| 2001/0055386 | A1 | 12/2001 | Waldron et al. | 379/444 |
| 2002/0141545 | A1 | 10/2002 | Segovia | 379/52 |
| 2003/0044033 | A1* | 3/2003 | Julstrom et al. | 381/315 |

* cited by examiner

*Primary Examiner* — Brian Ensey
(74) *Attorney, Agent, or Firm* — Glenn H. Lenzen; Husch Blackwell LLP

(57) ABSTRACT

An improved communication coupling device having a coupler coil with about 125 turns of wire about a bar-shaped core for use with a hearing aid having a hearing aid coil to accommodate individuals with various degrees of hearing loss to use a sound generation device such as a telephone.

9 Claims, 1 Drawing Sheet

APPARATUS FOR COMMUNICATION COUPLING WITH A HEARING AID

RELATED MATERIALS

This divisional application claims the benefit of U.S. Provisional Application No. 60/372,355, filed Apr. 12, 2002 and of U.S. Nonprovisional application Ser. No. 10/411,867 filed Apr. 11, 2003 now U.S. Pat. No. 7,317,807, both of which are hereby incorporated by reference.

BACKGROUND

The present invention relates generally to an improved communication coupling apparatus with a hearing aid. The invention may be used to improve communication between a telephone and an individual with different degrees of hearing loss.

Efforts have been made to improve coils for telephones such as in U.S. Publication No. 20010055386 to Waldron et al., hereby incorporated by reference, which describes an audio coupler device for use in communication with a T-coil of a hearing aid.

In addition, U.S. Pat. No. 3,396,245 to Flygstad, may describe the use of an inductance coil in an apparatus to enhance communication with a hearing aid device. Further, in U.S. Pat. No. 5,796,821 to Crouch et al., the patent may describe the use of a T-Coupler used in a hearing aid telephone interconnect system for connection between a telephone instrument and a conventional hearing aid.

US Publication No. 20020141545 to Segovia, may also describe the use of an induction coil to transfer audio signals from a telephone handset speaker to a hearing aid.

As these publications show, the use of different types of coils in conjunction with a telephone can be combined in various ways. However, none offer performance like some of the hearing impaired may need. Further, the use of a toroid has not been optimum in performance, and even the number if turns and other parameters whereby a wire is wound around a core appear not to have been optimized. It is now believed that the number of turns in a communication device appears to make a difference.

SUMMARY

The present invention provides an improvement to the clarity of the telephone sounds to the hearing-impaired wearer of a hearing aid. In an embodiment, the present invention discloses a hearing aid compatible device having about 125 turns of a wire around a core.

It is an object of the invention to provide a telecommunication device for universal application, meaning both people with hearing loss—including to the profound level or even deafness—and people without hearing loss can use the same telephone instrument.

It is another object of the invention to provide a device that may enable a hearing-impaired person to receive a clear audio signal from a sound transmission device, such as a telephone or the like.

These and other objects of the present invention will become more readily apparent from the consideration of the following summary and detailed discussion.

DETAILED DESCRIPTION

As can be understood from the discussion, the present invention may be embodied in a variety of ways. Although discussed in the context of a particular initial design, it should be understood that the various elements can be altered and even replaced or omitted to permit other designs and functionality as appropriate. Referring to the figures beginning with FIG. 1, it can be seen that in one sense the invention involves a sound generation device (1) which includes some sound generation source (2), a coupler coil (3) and a speaker (4).

In embodiments, the sound generation device (1) may have a receiver. A sound transmission line may be connected to the sound generation device (1). The sound transmission line may include, but is not limited to a telephone line or such an element which may transmit a signal of sound from an alternative source. The sound generation device (1) may include a standard telephone, cell phone or other types of phones, a headset, hands-free headset or earphone, or the like. The speaker, headset, hands-free headset or earphone, or the like may be used with telephones, cell phones, CD players, computers, electronic audio devices or some sort of audio output from a separate source. Accordingly, in embodiments, the sound generation device (1) may include any device that can be modified to include a coupler coil in accordance with the present invention whether or not it produces acoustic output.

Figure 1:
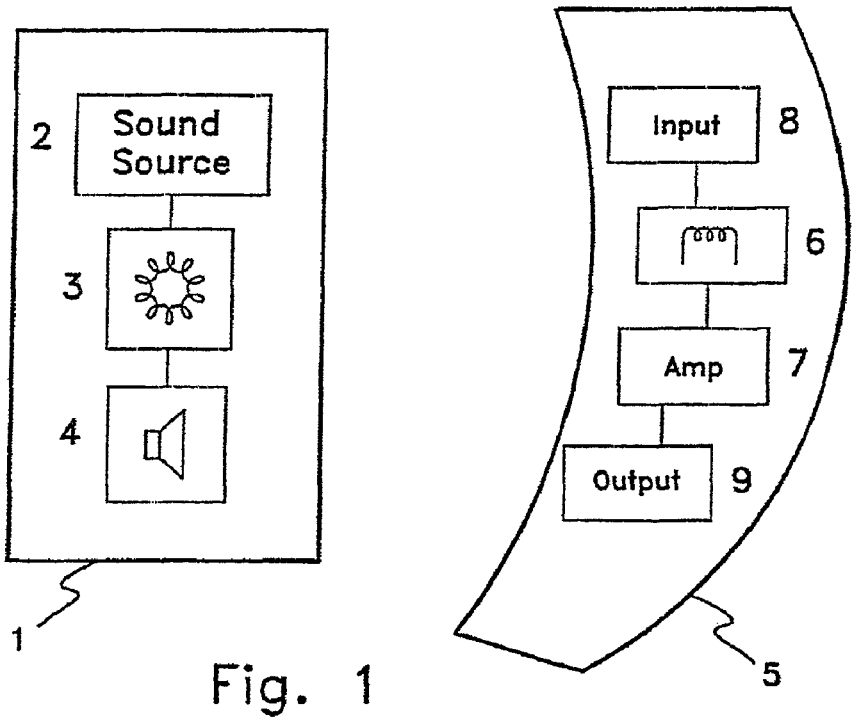
FIG. 1 schematically shows one embodiment of the communication coupling apparatus having a sound generation device and a hearing aid.

In an embodiment, the coupler coil (3) may be attached to the sound generation device (1), as illustrated in FIG. 1. In an embodiment, the speaker (4) may be powered by a speaker connection to a power source. Further, the coupler coil (3) and the speaker (4) may be connected to provide power to both the coupler coil (3) and the speaker (4). This connection may be in series or in parallel, as known to those skilled in the art. The impedance of the speaker (4) may be such that the addition of a proper coupler circuit does not impose a significant additional load.

As is known, an electromagnetic signal from a coupler device may be easily picked up by the coil of the hearing aid perhaps for final amplification and perhaps for acoustic delivery to the hearing impaired user.

In an embodiment, the coupler coil (3) may enable an inductive coupling of audio signals from a sound generation source (2) to a hearing aid (5). There may be magnetic coupling between the coupler coil (3) and the hearing aid coil (6).

Also, FIG. 1 shows a hearing aid (5) which may include in it a hearing aid coil (6), maybe a T-coil with some sort of amplifier (7) as traditionally known, an input (usually acoustic) (8) and an output (usually acoustic) (9).

Figure 2:
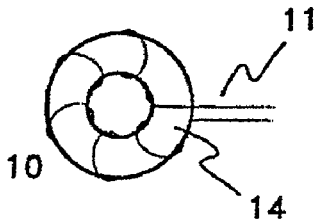
FIG. 2 shows one embodiment of the core of the present invention.

FIG. 2 describes a core (14) with a hole in it (10) and a wire (11) wrapped around the core with a hole (10). In FIG. 2, only a limited number of turns are shown to allow clarity of the picture. In an embodiment, the wire (11) may be wound around the core (14) for substantially about 125 turns. The wire (11) may even be round wire and may have a variety of gauges. In one embodiment, a 35 gauge wire may be used. The 125 turns of 35 gauge wire around a core having a hole may create an optimum magnetic field to couple with the hearing aid coil. Perhaps surprisingly, the amount of turns of wire onto a core may effect the clarity of the signal to a hearing-impaired person.

As another embodiment, the wire (11) may be wound around the core (14) for substantially about 250 turns of 40 gauge wire. There may be wire (11) left extending from the core (10) for soldering to the printed circuit board or other area of the sound generation device (1). It should be understood that the number of turns can vary, of course. In at least one embodiment, the wire is wound in a circular, alternating counter-clockwise and clockwise fashion to create two of more layers in opposite directions. Further, the wire may be beryllium.

In some embodiments, the core (10) may be made of material such as, but not limited to ferrite, ferromagnetic material, or the like. The coupler coil may also be used with an open air coil. In other embodiments, the core may be a bar shaped core or a simple inductive coil. In other embodiments, the core may even be a triangle shaped element, a circle shaped element or the like shaped element having a hole.

With a core of the type described herein, an enhanced coupling can be achieved with the coil of a hearing aid. As a result, the hearing aid is far less likely to drop a signal input from, for example, a telephone coil and dead spots in communication can be eliminated. These functional distinctions are an improvement over devices and systems described in the prior art.

Figure 3:
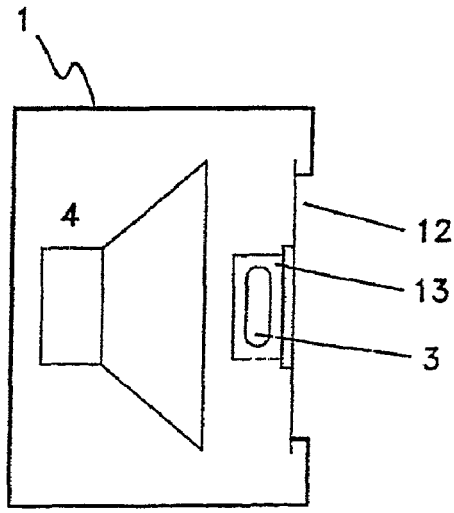
FIG. 3 shows a perspective view of one embodiment of the sound generation device.

In FIG. 3, a front surface (12) of a sound generation device (1) may include a coupler coil (3) with a coating or encapsulation (13). In an embodiment, the coupler coil (3) may be potted or perhaps encapsulated, perhaps with a potting compound to form a cylindrical structure. The coupler coil (3) may be placed inside the sound generation device (1). In an embodiment, the coupler coil (3) may be placed adjacent the front surface (12) of at least part of the receiver section of a sound generation device (1). This may provide a more efficient coupling with the hearing aid coil (6). In other embodiments, the coupler coil (3) may be located in the handset of a telephone. The coupler coil (3) may be encapsulated by an encapsulation (13). In some embodiments, the encapsulation (13) may be glued, connected to or adjacent to the front surface (12) of a receiver of a sound generation device (1). Of course, the coupler coil may be coated or encapsulated. In other embodiments, parts of the product or the entire product may be coated or encapsulated in an epoxy or other material to provide shock, moisture and tamper proof protection. The coupler coil (3) may be small, such as about 1 mm by about 1 mm. This small size may facilitate its incorporation within the receiver section of a sound generation device (1).

In embodiments, the present invention may be implemented with many wired as well as wireless communication devices. Further, the present invention may be used in various applications including, but not limited to desk, residential, office-key systems, pay phones, cordless phones, pps systems, emergency phones, radio/alarm and cd/cassette systems, ear phone systems, headset systems, telemarketing phone systems, interactive communication systems, fun design phones, sound ear-jack systems, recording-television studio headsets, CB radios, tour headset systems and airplane, bus, and rail headsets.

As can be easily understood from the foregoing, the basic concepts of the present invention may be embodied in a variety of ways. It involves both communication techniques as well as devices to accomplish the appropriate communication. In this application, the communication techniques are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Further, even other embodiments are disclosed in the application, but are not included in the claims. Importantly, as to all of the foregoing, all of these facets should be understood to be encompassed by this disclosure.

The discussion included in this application is intended to serve as a basic description. The reader should be aware that the specific discussion may not explicitly describe all embodiments possible; many alternatives are implicit. It also may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. Apparatus claims may be included for the device described, but also method or process claims may be added to address the functions the invention and each element performs. Neither the description nor the terminology is intended to limit the scope of the claims herein included.

It should also be understood that a variety of changes may be made without departing from the essence of the invention. Such changes are also implicitly included in the description. They still fall within the scope of this invention. A broad disclosure encompassing both the explicit embodiment(s) shown, a variety of implicit alternative embodiments, and the broad methods or processes and the like are encompassed by this disclosure and may be relied upon for support of claims in this application. This full patent application is designed to support a patent covering numerous aspects of the invention both independently and as an overall system.

Further, each of the various elements of the invention and claims may also be achieved in a variety of manners. This disclosure should be understood to encompass each such variation, be it a variation of an embodiment, an apparatus, a method or process, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all actions may be expressed as a means for taking that action or as an element which causes that action. Similarly, each physical element disclosed should be understood to encompass a disclosure of the action which that physical element facilitates. Regarding this last aspect, as but one example, the disclosure of a "coupler" should be understood to encompass disclosure of the act of "coupling"—whether explicitly discussed or not—and, conversely, were there effectively disclosure of the act of "coupling", such a disclosure should be understood to encompass disclosure of a "coupler" and even a "means for coupling". Such changes and alternative terms are to be understood to be explicitly included in the description.

Any patents, publications, or other references mentioned in this application for patent or listed in an attached information disclosure statement are hereby incorporated by reference. In addition, as to each term used it should be understood that unless its utilization in this application is inconsistent with such interpretation, common dictionary definitions should be understood as incorporated for each term and all definitions, alternative terms, and synonyms such as contained in the Random House Webster's Unabridged Dictionary, second edition are hereby incorporated by reference. Finally, as to all references listed or specifically mentioned, each is hereby appended and hereby incorporated by reference, however, as to each of the above, to the extent that such information or statements incorporated by reference might be considered inconsistent with the patenting of this/these invention(s) such statements are expressly not to be considered as made by the applicant(s).

Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible.

The claims set forth in this specification are hereby incorporated by reference as part of this description of the invention, and the applicant expressly reserves the right to use all of or a portion of such incorporated content of such claims as additional description to support any of or all of the claims or any element or component thereof and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof.

What is claimed is:

1. A communication coupling system comprising:

a sound generation device having a receiver;

a sound transmission line connected to said sound generation device, said sound generation device having substantially 125 turns of 35 gauge wire wound around a bar-shaped core of a coupler coil in two or more layers, wherein the layers are wound in alternating clockwise and counter-clockwise directions;

a hearing aid coil located in a hearing aid; and a speaker located in said sound generation device.

2. The communication coupling system of claim 1, wherein said core of said coupler coil comprises ferrite.

3. The communication coupling system of claim 1, wherein said speaker is powered by a speaker connection and said coupler coil is powered by said speaker connection.

4. The communication coupling system of claim 1, wherein said sound generation device is selected from the group consisting of a standard telephone, a cell phone, an earpiece connected to a telephone, a headset connected to a telephone, an electronic audio headset, an earpiece connected to a CD player, and an earpiece connected to a computer.

5. The communication coupling system of claim 1, wherein said wire includes beryllium.

6. The communication coupling system of claim 1, wherein at least part of said receiver comprises said coupler coil.

7. The communication coupling system of claim 1, wherein said sound generation device includes a front surface, and further wherein said coupler coil is adjacent to said front surface.

8. The communication coupling system of claim 1, wherein said coupler coil comprises an encapsulation.

9. A communication coupling system of claim 1, wherein said sound generation device comprises a telephone having a handset and said coupler coil is located in said handset.

* * * * *